US005710969A

United States Patent [19]

Newman

[11] Patent Number: 5,710,969

[45] Date of Patent: Jan. 20, 1998

[54] INSERT SINTERING

[75] Inventor: David P. Newman, Arvada, Colo.

[73] Assignee: Camax Tool Co., Arvada, Colo.

[21] Appl. No.: 613,215

[22] Filed: Mar. 8, 1996

[51] Int. Cl.[6] ..... B22F 3/10

[52] U.S. Cl. ..... 419/5; 419/8; 419/38; 419/47; 75/228; 264/56; 264/63; 264/DIG. 3; 264/DIG. 67

[58] Field of Search ..... 419/5, 8, 38, 47; 75/228; 264/56, 63, 59, DIG. 36, DIG. 67, 71

[56] References Cited

U.S. PATENT DOCUMENTS

| | | | |
|---|---|---|---|
| 2,373,405 | 4/1945 | Lowit | 29/156 |
| 3,992,202 | 11/1976 | Dulis et al. | 75/222 |
| 4,470,953 | 9/1984 | Bruce | 419/6 |
| 4,595,556 | 6/1986 | Umeha et al. | 419/8 |
| 4,616,389 | 10/1986 | Slee | 29/156.4 |
| 4,729,789 | 3/1988 | Ide et al. | 75/244 |
| 4,847,962 | 7/1989 | Puetz | 29/149.5 PM |
| 4,969,262 | 11/1990 | Hiraoka et al. | 29/888.1 |
| 5,013,611 | 5/1991 | Suzuki et al. | 428/552 |
| 5,273,710 | 12/1993 | Zengin | 419/47 |

*Primary Examiner*—Charles T. Jordan
*Assistant Examiner*—Daniel Jenkins
*Attorney, Agent, or Firm*—Joseph G. Nauman

[57] ABSTRACT

A method of controlling chosen geometries in sintering operations uses an insert in the preform which is to be sintered, which insert can withstand sintering temperatures without distortion, and which will not bond to the preform and thus prevent removal subsequent to sintering. In powder metal sintering, inexpensive ceramic alumina inserts satisfy these criteria. A powdered metal preform is caused to shrink onto a precisely formed ceramic insert, thereby to determine final shape accurately. An insert larger in diameter than that of the uninserted undistorted preform final diameter may be used if potential impact on geometry density is factored into its selection. An insert shape other than that of the preform undistorted final shape may be used to create final geometries different by design than those of the preform.

7 Claims, 1 Drawing Sheet

Without Insert
Ring ID = X

With Insert
Ring ID = X
Insert OD = .9X

Powder metal ring
after sintering

After Insert
Removed

INSERT SINTERING

BACKGROUND OF THE INVENTION

Sintering is an elevated temperature process whereby a particulate material, for instance powder metal, may be caused to coalesce into an essentially solid form having the same or nearly the same properties of the material in wrought form. By compressing a powdered form of a material such as steel into a preform, raising the temperature close to but below its melting temperature, and holding it there for some extended period, inter-particulate surface melting occurs and the material densifies toward becoming completely solid.

In general, complete solidification does not occur, but sintered density can approach the high 90's percentile. As the densification process occurs the interstitial voids of the preform shrink in size and lessen in number. As a consequence, the resultant bulk volume of the sintered part is significantly less than that of the compressed preform. As the preform shrinks, opportunities for geometrical deformity occur, which is the problem addressed by this invention.

For example, a circular ring preform may shrink to its final density in the form of an indeterminate oval, as frictional drag forces (between it and whatever supports it in the sintering furnace) act on it irregularly. Also, any variation in preform density around the circumference of the ring will tend to induce variable shrinkage, again resulting in a final sintered part that is non-circular.

In general, during the period of densification while the preform is exposed to high temperature, it has little strength to resist deforming influences, and it is a recognized challenge in sintering powdered metal parts to achieve final geometries completely congruent to the preform. The ultimate dimensional tolerances that can be held are limited by these variations in geometry. Failures in this regard lead to costly secondary operations such as machining and ball sizing, or scrap.

Accordingly, there is a need for a simple yet reliable way to control sintered part geometry, improving tolerances, eliminating secondary operations and reducing scrap without unnecessarily increasing cost.

SUMMARY OF THE INVENTION

The present invention provides a novel, simple and inexpensive method of controlling chosen geometries in sintering operations. This is accomplished by the use of an insert with appropriate properties. Such properties are that the insert not be adversely affected by the sintering environment, e.g. that it withstand sintering temperatures without distortion, and that it not bond to the preform and thus prevent removal subsequent to sintering. In powder metal sintering, inexpensive ceramic alumina inserts satisfy these criteria. By allowing a powder metal preform to shrink onto a precisely formed ceramic insert, it is possible to determine final shape very accurately. In sintering a metal preform ring as discussed above, for example, a ceramic ring or disk may be used as the insert. Such an insert, with an outside diameter at or slightly larger than the inside diameter to which the preform would shrink without any deforming influences, is placed in the interior of the preform, thereby limiting preform shrinkage to the outside shape of the insert. In practice, an insert with an outside diameter even less than the undeformed sintered preform will provide benefit, as it will limit the degree to which deformity can occur.

An insert larger in diameter than that of the uninserted undistorted preform final diameter may also be used if potential impact on geometry density is factored into its selection. Preventing the preform from achieving the smallest undistorted diameter it would reduce to without the insert, may also prevent the preform from achieving maximum density, in some cases.

A further aspect of this invention is that an insert shape other than that of the preform undistorted final shape may be used to create final geometries different by design than those of the preform. For instance, an array of precise oval steel shapes could be desired. Machining punch and die sets for pressing such an array of preforms would be difficult, time-consuming and very costly compared to machining the relatively simple punch and die set for pressing a single circular preform. This circular preform could then be inserted with a variety of relatively easily-ground ceramic ovals and subsequently sintered to create the desired array.

The principles of insert sintering are applicable to geometries other than circular, and materials other than steel, being limited only by the requirements that the preform shrink toward a suitable insert and, if required, that the insert can be removed after sintering. This last requirement can be met easily in some metallic applications where a sliding removal is difficult by simply shattering an inexpensive ceramic insert.

The principal objective of this invention, therefore, is to provide a novel and simple inexpensive method by which chosen final shapes may be controlled in sintering technologies using unique shapes of inserts, which may be expendable, added to the part during sintering, to control shrinkage of a finished sintered part.

Other objects and advantages of the invention will be apparent from the following description, the accompanying drawings and the appended claims.

DESCRIPTION OF THE PREFERRED EMBODIMENT

Figure 1:
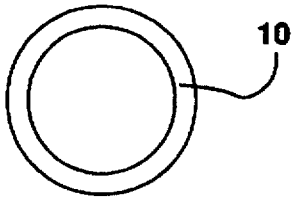
FIG. 1 is a view of a compressed circular powder metal preform ring about to be sintered conventionally, by placing it on a rack in a sintering furnace.
Figure 2:
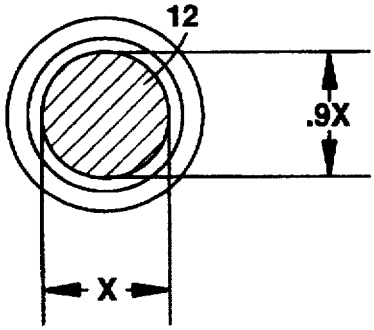
FIG. 2 is a view of a compressed circular powder metal preform ring about to be sintered according to the teaching of this invention, using a circular ceramic disk insert within the preform as it is placed on a rack in a sintering furnace.
Figure 3:
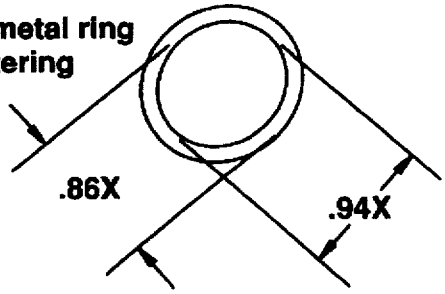
FIG. 3 is a view of the ring as sintered conventionally without an insert showing typical distortion from circularity, this figure being exaggerated for description purposes.

As illustrated in FIG. 1, a compressed powder metal preform 10 is prepared for sintering, it being desired in this case that the resultant sintered part retain precise circularity. Because of the likelihood that distortions such as depicted in FIG. 3 may occur, preparations according to this invention are made as shown in FIG. 2.

Figure 4:
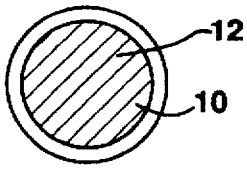
FIG. 4 is a view of a ring as sintered according to the teaching of this invention, showing the sintered metal part reduced in diameter to the outside diametrical limits of the preform.
Figure 5:
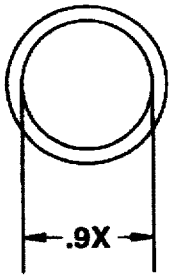
FIG. 5 is a view of the ring of FIG. 4 with the insert removed, showing the resultant uniform circular shape as a consequence of sintering with the insert.

A ceramic disk 12 is prepared having an outside diameter designed to control the preform internal diameter after sintering shrinkage. In this case, the outside diameter of the insert disk 12 is 90% of the starting internal diameter of the preform, since it is anticipated that the preform 10 will shrink during sintering to this extent. The disk 12 is inserted in preform 10 prior to sintering. FIG. 4 shows the two components after sintering, with the preform now a sintered ring snugly fitted to the ceramic insert. FIG. 5 shows the final part, after the insert has been removed, with desired precisely determined circular geometry.

While the method and the product herein described constitute preferred embodiments of the invention, it is to be understood that the invention is not limited to this precise method and product, and that changes may be made therein without departing from the scope of the invention which is defined in the appended claims.

What is claimed is:

1. A method of sintering in which a removable ceramic insert is placed in conjunction with a preform to be sintered whereby final shape of a chosen preform geometry is limited by the shape of the insert.

2. The method of sintering as defined in claim 1 in which an insert is placed in conjunction with a preform to be sintered whereby the final shape of the sintered part is determined by the insert to be different in kind from the initial shape of the preform.

3. A method of claim 2 in which the insert is of a ceramic material and the preform is of powder metal.

4. A sintered product made according to the method of claim 1.

5. The method of claim 1 wherein the insert is of an expendable removable material.

6. A method of sintering in which an insert is placed in conjunction with a preform to be sintered whereby final shape of a chosen preform geometry is limited by the shape of the insert, wherein the insert is of a ceramic material and the preform is of powder metal.

7. A sintered product made according to the method of claim 6.

* * * * *